US005709809A

United States Patent [19]

Lee

[11] Patent Number: 5,709,809

[45] Date of Patent: Jan. 20, 1998

[54] MODULAR WALL FORM ASSEMBLY

[76] Inventor: Wen-Yuan Lee, 7F-3, No. 8, Lane 390, Sec. 1, Chien-Kang Rd., Tainan City, Taiwan

[21] Appl. No.: 622,467

[22] Filed: Mar. 25, 1996

[51] Int. Cl.[6] ..... E04G 11/10

[52] U.S. Cl. ..... 249/195; 249/47; 249/192; 249/194; 249/196

[58] Field of Search ..... 249/47, 192, 194, 249/195, 196

*Primary Examiner*—Thomas R. Weber

*Attorney, Agent, or Firm*—Merchant, Gould, Smith, Edell, Welter & Schmidt, P.A.

[57] ABSTRACT

A modular wall form assembly includes two adjacent form units and a fastening lever. Each of the form units has an upright flat panel, a connecting plate extending rearwardly and inclindedly from the mating edge of the flat panel. Each of the connecting plates has a positioning hole which has a generally oblong cross-section which has two opposed side walls defining its width. The connecting plates contact complementarily one another and the positioning holes are at least partially aligned with one another. The fastening lever has a handle portion and a fastening portion. The fastening portion has a base portion, a neck portion and an enlarged head portion. Each of the neck and head portions has a generally oblong cross-section. The neck portion has two opposed shorter sides in the lengthwise direction. The head portion of the fastening lever can extend through the positioning holes with the neck portion being received in the positioning holes when positioning holes are at least partially aligned with one another. The shorter sides of the neck portion push the side walls of the positioning holes when the handle portion is rotated in order to permit the side walls to be flush with one another and to clamp the connecting plates between the head and base portions of the fastening lever.

6 Claims, 13 Drawing Sheets

MODULAR WALL FORM ASSEMBLY

BACKGROUND OF THE INVENTION

1. Field of the Invention

This invention relates to a modular wall form assembly, more particularly to a modular wall form assembly which has form units and apparatus that is used to connect and disconnect quickly the adjacent form units quickly.

2. Description of the Related Art

Modular steel forms have been widely used for constructing a concrete structure. To obtain a desired width of a concrete wall of a structure, a plurality of form units 1 may be selected to have different widths and secured side-by-side to form a modular wall form assembly, as shown in FIG. 1. The wall form assembly may be used repeatedly to construct the wall of the same structure, thereby saving a large amount of time and manpower for dismantling and assembling the wall form assembly. However, in some cases, for example, after the surrounding walls of an enclosed room has been formed, the wall form assembly used in the room must be dismantled into small pieces which can be passed manually through the various openings in the surrounding walls so as to be assembled anew. Thus, it is always a need to improve the apparatus used to connect and disconnect two adjacent form units so as to achieve faster and more efficient construction of at a lower manpower requirement.

In addition, since the mold panels of the modular wall form assembly are in tight contact with the concrete wall faces after the concrete walls are hardened, the form assembly cannot be removed conveniently from the concrete walls.

SUMMARY OF THE INVENTION

It is therefore an object of the present invention to provide a modular wall form assembly which has from units that can be connected to and disconnected from one another quickly.

Another object of the present invention is to provide a modular wall form assembly which can be removed easily after a concrete wall has been formed.

According to an aspect of the present invention, a modular wall form assembly comprises two adjacent form units and a fastening lever. Each of the form units has an upright flat panel with a mating edge, a connecting plate extending rearwardly and inclindedly from the mating edge of the flat panel. Each of the connecting plates has a positioning hole which has a generally oblong cross-section with a width, a length which is larger the width, and a pair of opposed side walls defining the width. The connecting plates are adapted to contact complementarily one another when the flat panel are disposed side-by-side so that the positioning holes are at least partially aligned with one another.

The fastening lever has a handle portion and a fastening portion formed on one end of the handle portion. The fastening portion has a base portion with a flat fastening face, and a neck portion which projects from the fastening face and which has a generally oblong cross-section with a length and a width that equals the width of the first and second positioning holes. The neck portion has two opposed shorter sides. The fastening portion further has an enlarged head portion which is connected to a distal end of the neck portion. The head portion has a generally oblong cross-section and a longitudinal axis parallel to that of the neck portion in order to form a clamping space between the head portion and the fastening face of the base portion. The head portion has a width which is smaller than the width of the positioning holes and a length which is smaller than the length of the positioning holes so that the head portion of the fastening lever can extend through the positioning holes with the neck portion being received in the positioning holes when positioning holes are at least partially aligned with one another.

After the head portion has been extended through the positioning holes and the neck portion has received in the positioning holes while the positioning holes are partially aligned, the fastening lever can be rotated such that the shorter sides of the neck portion abut tightly against the side walls of the positioning holes and the side walls are received in the clamping space between the head portion and the base portion, thereby pushing the side walls to be flush with one another and retaining the first and second connecting plates between the head portion and the base portion of the fastening lever. Preferably, the distance between head portion and the fastening face of the base portion is equal to the combined thickness of the connecting plates so that the fastening portion can clamp tightly the connecting plates together.

Preferably, the longitudinal axis of each of the positioning holes is parallel to the mating edges of the flat panels so that the front faces of the flat panels can be flush with one another when the side walls of the positioning holes are flush with one another. Alternatively, the longitudinal axis of each of the positioning holes is perpendicular to the mating edges of the flat panels so that the top and bottom edges of the flat panels can be flush with one another when the side walls of the positioning holes are flush with one another. In addition, the longitudinal axis of each of the positioning holes may be parallel to the mating edges of the flat panels and the front faces of the flat panels are flush with one another when the positioning holes are partially aligned so that a clearance is formed between the front faces of the flat panels when the side walls of the positioning holes are flush with one another.

According to another aspect of the present invention, a modular wall form assembly comprises two adjacent form units and a clamping lever.

Each of the form units has an upright flat panel with a mating edge, a connecting plate extending rearwardly and inclindedly from the mating edge of the flat panel. Each of the connecting plates has a distal edge which is formed with a hook portion. The connecting plates are adapted to complementarily contact one another. The hook portions engage fittingly and removably one another when the connecting plates contact one another.

The clamping lever has a handle portion and a hook-shaped portion. The hook-shaped portion having a first curved section which extends from one end of the handle portion, and a second curved section which extends from a distal end of the first curved section. The second curved section has a distal end which forms a clearance with the first curved section. The clearance has a width equal to the combined thickness of the first and second hook portions.

After the first hook portions engage one another, the first and second hook portions can be inserted into the hook-shaped portion of clamping lever via the clearance and clamped between the first curved section and the distal end of the second curved section of the clamping lever.

BRIEF DESCRIPTION OF THE DRAWINGS

Other features and advantages of this invention will become apparent in the following detailed description of the preferred embodiments of this invention with reference to the accompanying drawings, in which.

DETAILED DESCRIPTION OF THE PREFERRED EMBODIMENTS

Figure 1:
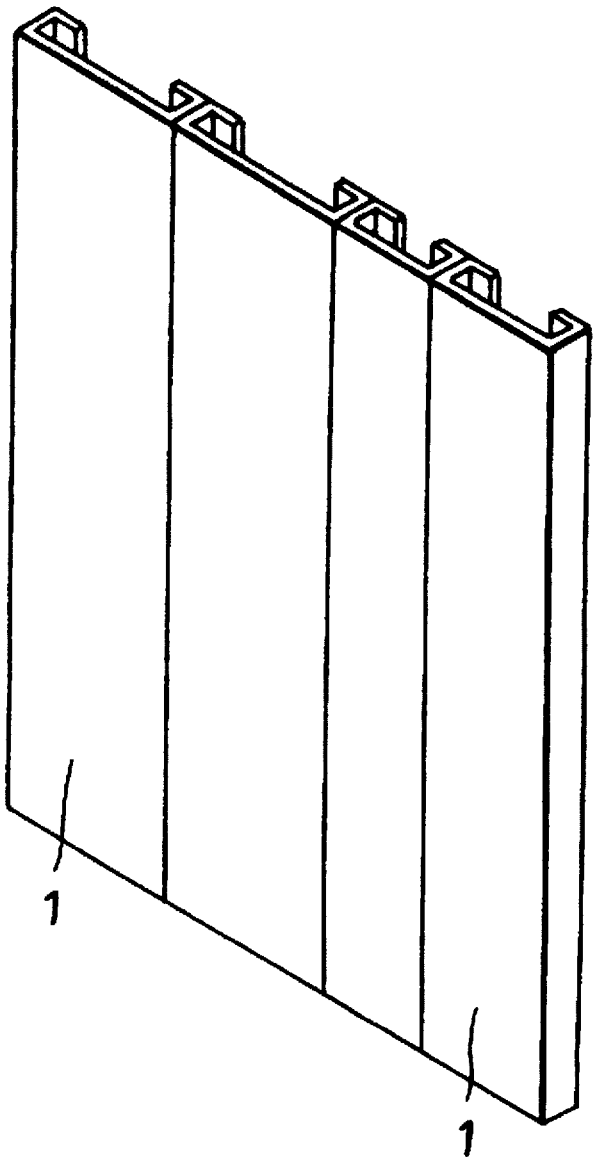
FIG.1 PRIOR ART
FIG. 1 is a perspective view of a conventional modular wall form assembly which has a plurality of wall form units.
Figure 2:
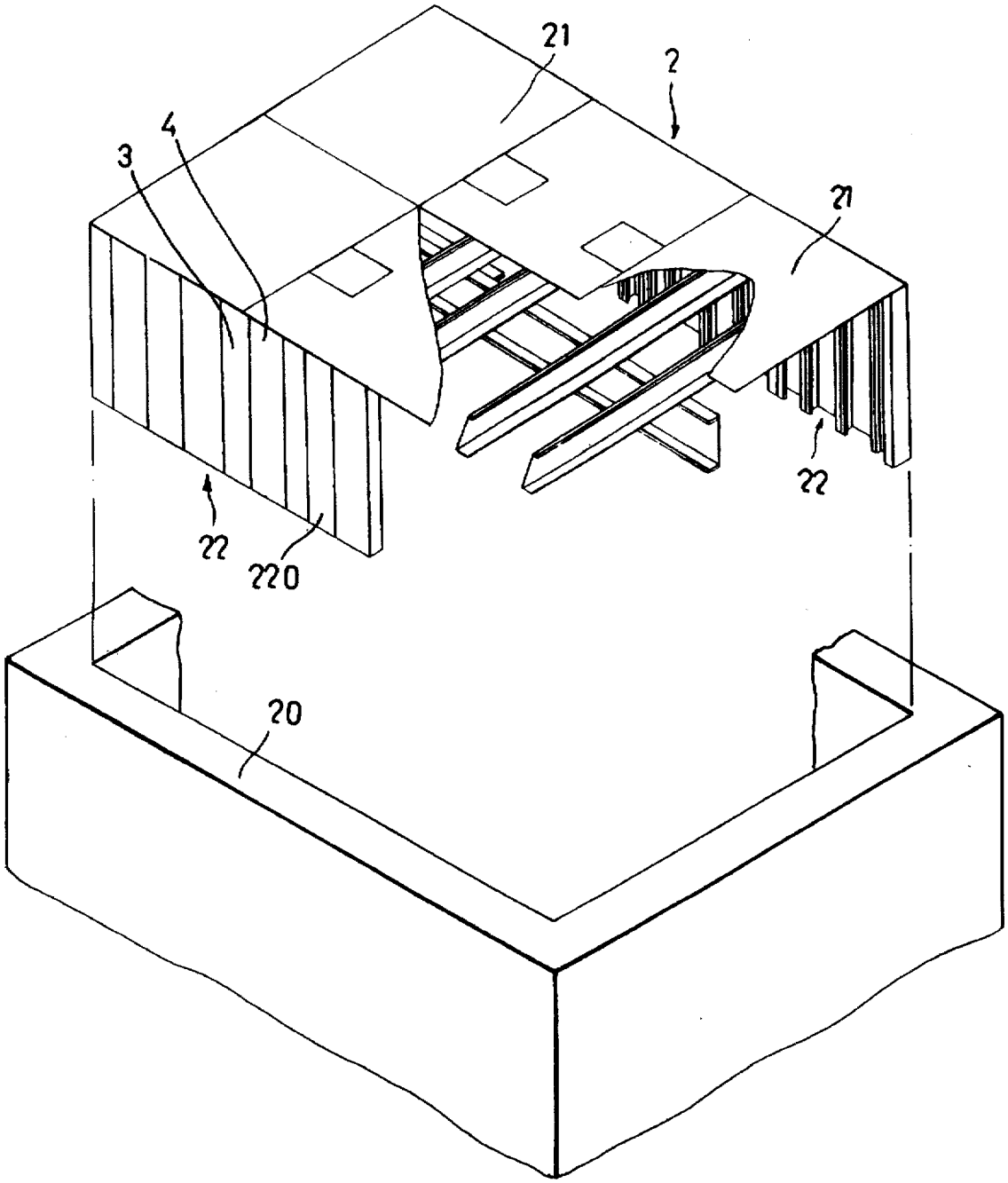
FIG. 2 is a perspective schematic view illustrating how the conventional modular wall form assembly is used with a modular floor form assembly.

Referring to FIG. 2, a floor form assembly 2 is adapted for use in the construction of a concrete floor of a structure that is enclosed by surrounding walls 20, and comprises a plurality of horizontal floor form units 21 and a vertical wall form assembly 22 which has a plurality wall form unit 220 that are arranged side-by-side so that most of the form units 220 can be interconnected by means of bolts and nuts. The wall form units 220 are interconnected to form an enclosed frame that is inserted into the room defined by the surrounding walls 20 via the top of the latter so as to be disposed beside top portions of the surrounding walls 20. Two adjacent form units 3, 4 of the form units 220 are interconnected by means of fastening levers 5, 6 and a clamping lever 7 according to the present invention so that the form units 220 can be assembled and dismantled quickly in order to achieve faster and more construction at a lower manpower requirement.

Figure 3:
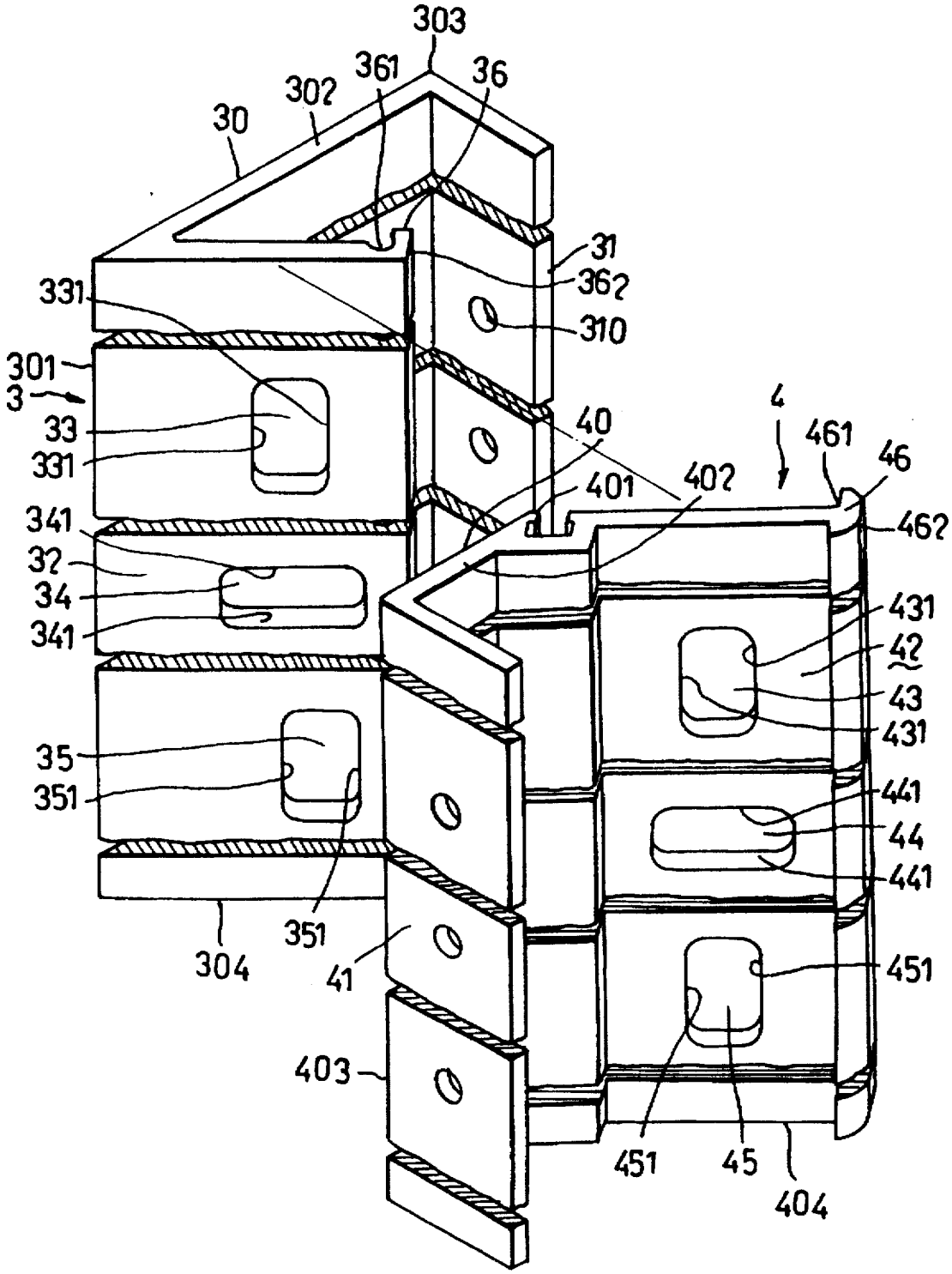
FIG. 3 is a perspective exploded view of a preferred embodiment of two adjacent form units of a modular wall form assembly according to the present invention.
Figure 4:
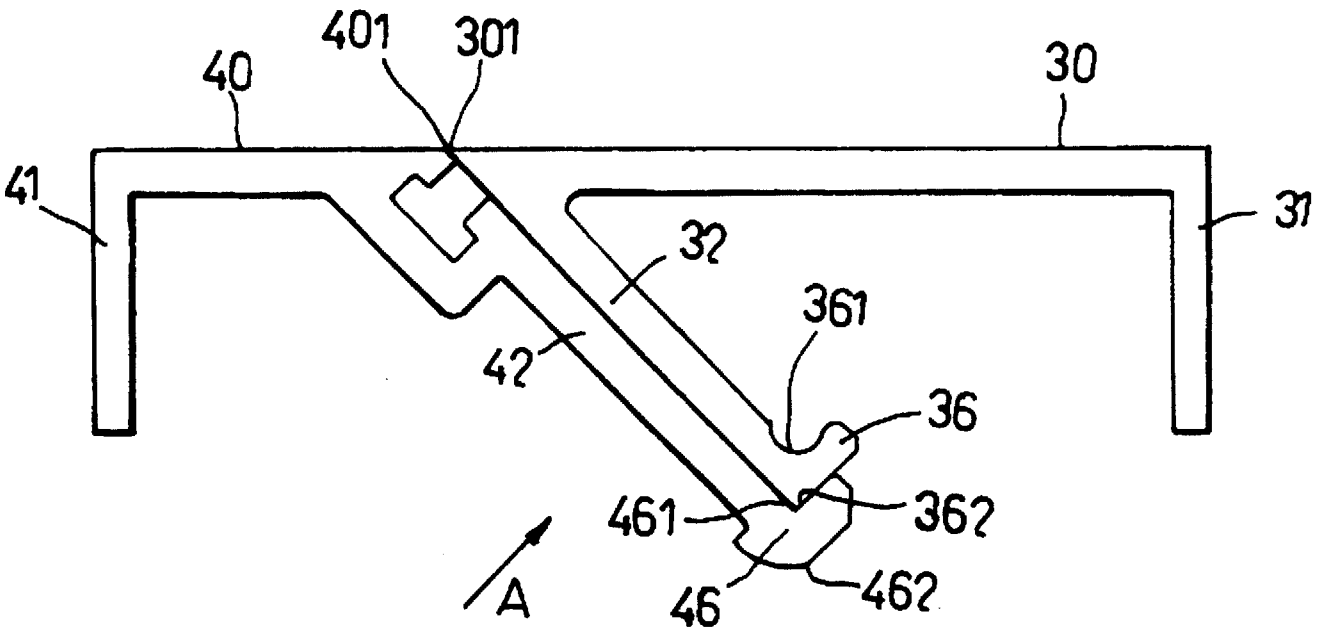
FIG. 4 is a top view of the adjacent form units of the modular wall form assembly according to the present invention.

Referring to FIGS. 3 and 4, the first form unit 3 is an aluminum-extruded member and an upright flat panel 30 with a mating edge 301. The flat panel 30 has a joining plate 31 which extends perpendicularly from the edge 303 that is opposite to the mating edge 301. The joining plate 31 is formed with a plurality of holes 310 so that the first form unit 3 can be connected to one of the form units 220 by bolts and nuts. The flat panel 30 further has a connecting plate 32 extending rearwardly and inclindedly from the mating edge 301 of the flat panel 30. The connecting plate 32 has an upper positioning hole 33, an intermediate positioning hole 34, and a lower positioning hole 35 which are formed sequentially in a direction from the top edge 302 to the bottom edge 304. Each of the positioning holes 33, 34, 35 has a generally oblong cross-section with a width, a length which is larger the width, and a pair of opposed side walls 331, 341, 351 which define the width of a corresponding one of the positioning holes 33, 34, 35.

Each of the upper and lower positioning holes 33 and 35 has a longitudinal axis that is parallel to the mating edge 301 of the flat panel 30 so that the side walls 331, 351 are parallel to the same. However, the longitudinal axis of the intermediate positioning hole 34 is perpendicular to the mating edge 301 of the flat panel 30.

The distal end of the connecting plate 32 is formed with a first hook portion 36 with an inner face 361 and an outer face 362.

The second form unit 4 is an aluminum-extruded member and an upright flat panel 40 with a mating edge 401. The flat panel 40 has a joining plate 41 which extends perpendicularly from the edge 403 that is opposite to the mating edge 401. The joining plate 401 is formed with a plurality of holes 410 so that the second form unit 4 can be connected to one of the form units 220 by bolts and nuts. The flat panel 40 further has a connecting plate 42 extending rearwardly and inclindedly from the mating edge 401 of the flat panel 40. The connecting plate 42 is complementary to the connecting plate 32 so that the front faces of the flat panels 30, 40 can be connected to form a contiguous plane when the connecting plates 32, 42 contact one another, as best illustrated in FIG. 4. The connecting plate 42 has an upper positioning hole 43, an intermediate positioning hole 44, and a lower positioning hole 45 which are formed sequentially in a direction from the top edge 402 to the bottom edge 404. Each of the positioning holes 43, 44, 45 corresponds in size and shape with a corresponding one of the positioning holes 33, 34, 35 and is at least partially aligned with the same. Each of the positioning holes 43, 44, 45 has a pair of opposed side walls 431, 441, 451.

Figure 5:
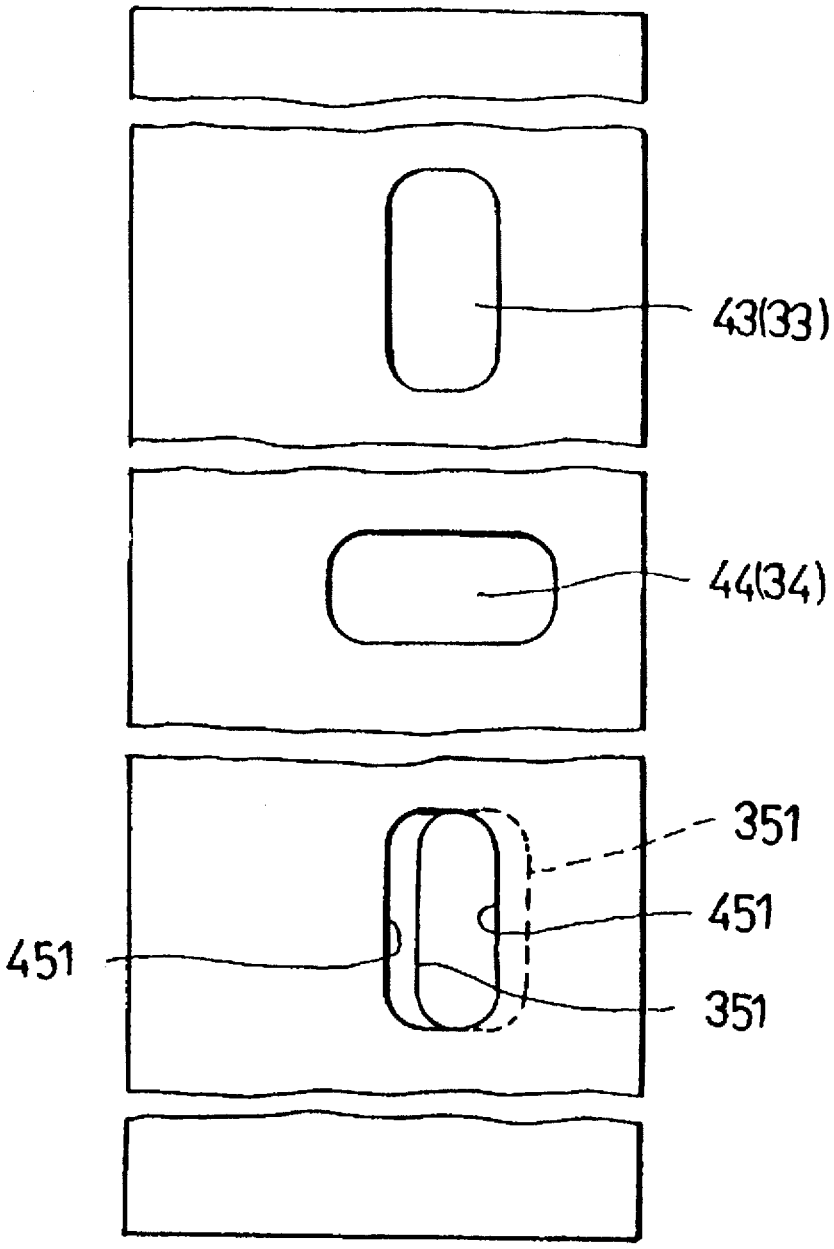
FIG. 5 is a plan view when viewing from the arrow (A) of FIG. 4.

Referring to FIGS. 4 and 5, when the side walls 331, 431 of the upper positioning holes 33, 43 are flush with one another, the mating edges 301, 401 and therefore the front faces of the flat panels 30, 40 are flushed with one another. When the side walls 341, 441 of the intermediate positioning holes 34, 44 are flush with one another, the top and bottom edges 302, 304 of the flat panel 30 are flushed with the respective top and bottom edges 402, 404 of the flat panel 40. Furthermore, when side walls 331, 431 and the side walls 341, 441 are both flush with one another, the lower positioning holes 35, 45 are partially aligned with one another such that the side walls 351 are staggered with the side walls 451. In this time, the front faces of the flat panels 30, 40 are flush with one another. In addition, the distal end of the connecting plate 42 is formed with a second hook portion 46 with an inner face 461 and an outer face 462. The inner face 461 of the second hook portion 46 complements to the outer face 362 of the first hook portion 36 so that the first and second hook portions 36, 46 can engage fittingly and removably one another when the flat panels 30, 40 are flush with one another, as best illustrated in FIG. 4.

Figure 7:
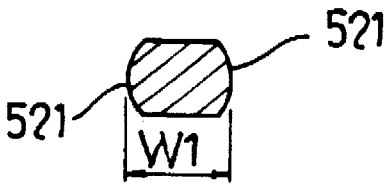
FIG. 7 is a cross sectional view of the neck portion of the fastening lever of FIG. 6.
Figure 6:
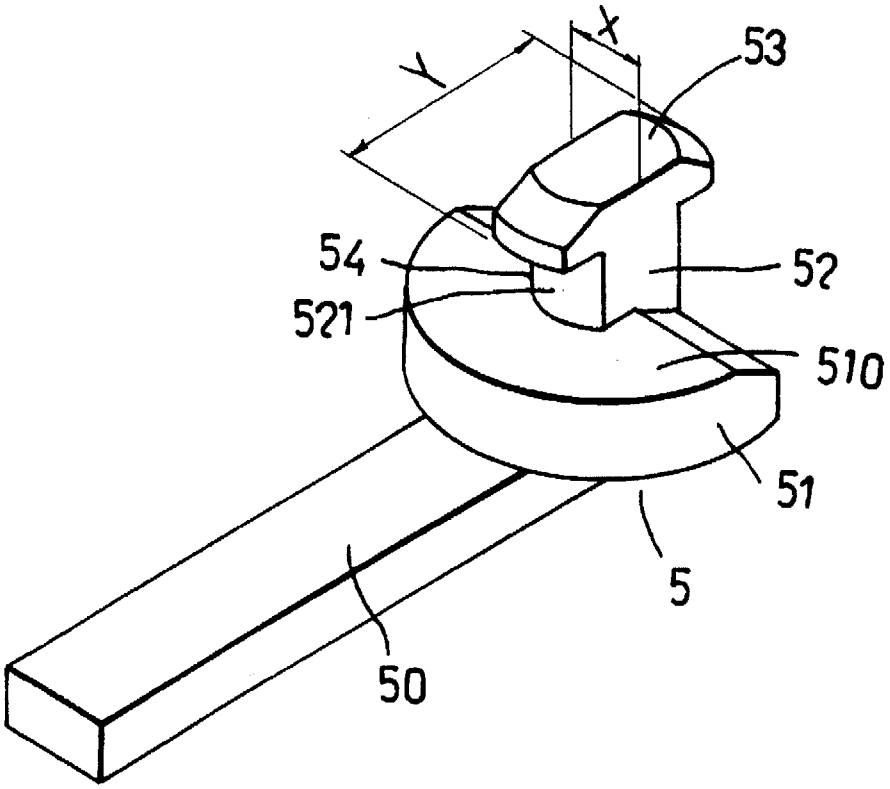
FIG. 6 is a perspective view of a preferred embodiment of a fastening lever of the modular wall form assembly according to the present invention.

Referring to FIGS. 6 and 7, a first fastening lever 5 is shown to comprise a handle portion 50 and a fastening portion which is formed on one end of the handle portion 50. The fastening portion has a base portion 51 with a flat fastening face 510, and a neck portion 52 which projects from the fastening face 510, and an enlarged head portion connected to a distal end of the neck portion 52. The neck portion 52 has a generally oblong cross-section with two opposed curved shorter sides 521 which define a width (W1) therebetween. The width (W1) equals the width of the upper and lower positioning holes 33, 43, 34, 44. The head portion 53 has a generally oblong cross-section and a longitudinal axis parallel to that of the neck portion 52 in order to form a clamping space 54 between the head portion 53 and the fastening face 510 of the base portion 51. The head portion 53 has a width (X) which is smaller than the width of each of the positioning holes 33, 43, 34, 44 and a length (Y) which is smaller than the length of each of the positioning holes 33, 43, 34, 44 so that the head portion 53 of the fastening lever 5 can extend through the second positioning holes 33, 43, 34, 44 with the neck portion 52 being received in the latter when the latter are at least partially aligned with one another. The head portion 53 is displaced from the fastening face 510 by a distance which equals to the combined thickness of the connecting plates 32, 42 in order to clamp tightly the connecting plates 32, 42 between the head portion 53 and the base portion 51. The longitudinal axis of the handle portion 50 extends in a same direction of the longitudinal axis of the neck portion 52.

Figure 9:
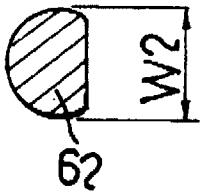
FIG. 9 is a cross sectional view of the neck portion of the fastening lever of FIG. 8.
Figure 8:
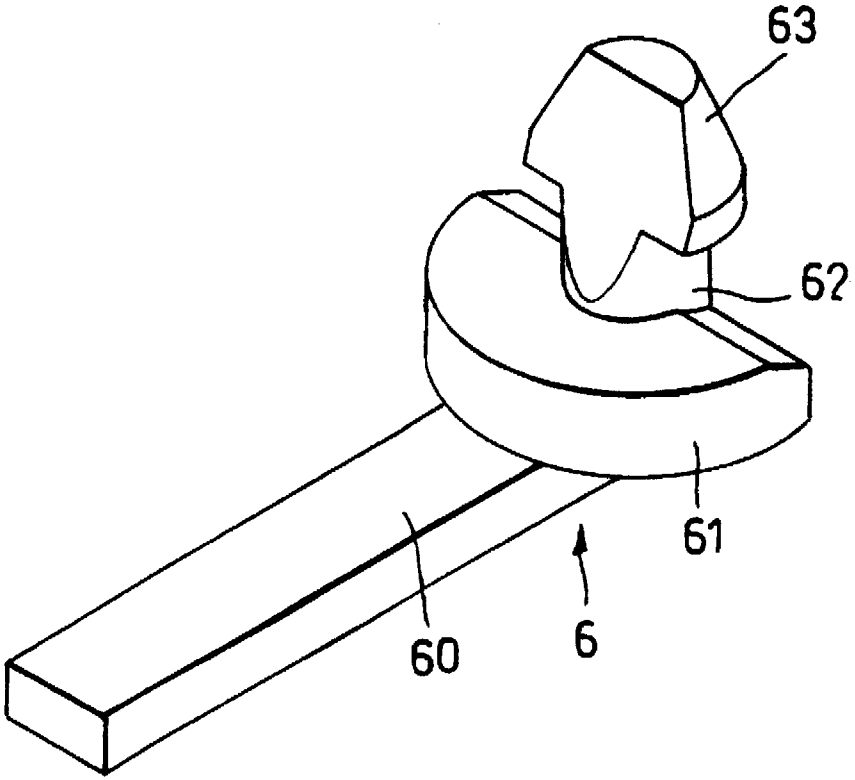
FIG. 8 is a perspective view of an alternative form of the fastening lever of the modular wall form assembly according to the present invention.

Referring to FIGS. 8 and 9, a second fastening lever 6 is shown to comprise a handle portion 60, a base portion 61, a neck portion 62 and a head portion 63 which are constructed and arranged in a manner similar to those of the first fastening lever 5. However, because the second fastening lever 6 is especially designed to be used with the lower positioning holes 35 which are partially aligned such that the through hole confined by the lower positioning holes 35, 45 is normally narrower than the width of the head portion 53 of the first fastening lever 5, the head portion 63 of the second fastening lever 6 is tapered away from the neck portion 62 in order to pass through the through hole of confined by the partially aligned lower positioning holes 35, 45. The width (W2) of the neck portion 62 is equal to the that of each of the positioning holes 35, 45. The longitudinal axis of the handle portion 60 extends in a direction which is perpendicular to the longitudinal axis of the neck portion 62.

Figure 10:
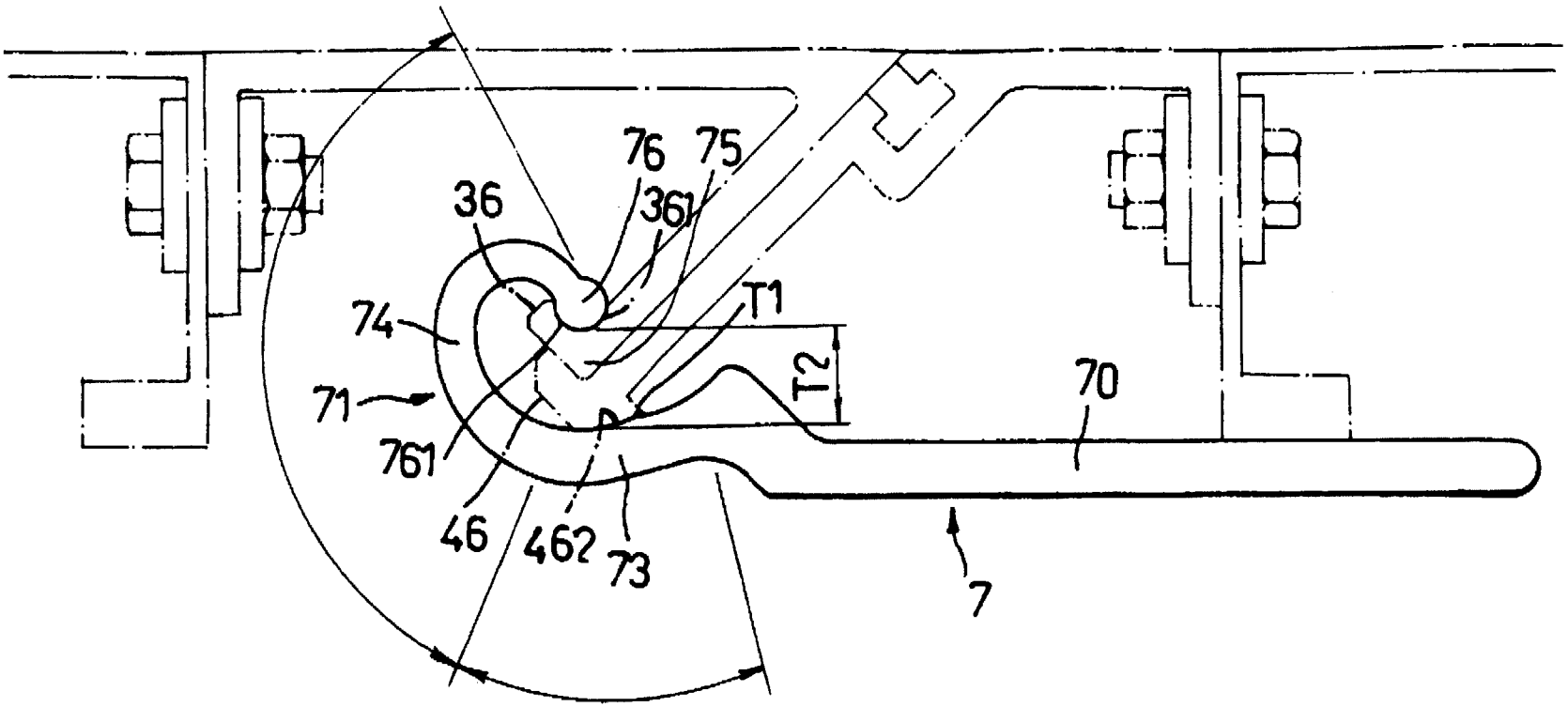
FIG. 10 is a top schematic view illustrating how a clamping lever of the modular wall form assembly according to the present invention clamps the hook portions of the connecting plates of the adjacent form units.

Referring to FIG. 10, a clamping lever 7 is shown to comprise a handle portion 70 and a hook-shaped portion 71. The hook-shaped portion 71 has a first curved section 73 which extends from one end of the handle portion 70, and a second curved section 74 which extends from a distal end of the first curved section 73. The second curved section 74 has a distal end 76 which forms a clearance 75 with the first curved section 73. The clearance 75 has a width (T2) equal to the combined thickness of the first and second hook portions 36, 46. The distal end 76 is formed with a curved face 761 which complements to the inner face 361 of the first hook portion 36. A projection (T1) is formed on the inner face of the first curved section 73 to sever as a mark point when the first and second hook portions 36, 46 are held in position by the hook-shaped portion 71.

Figure 11:
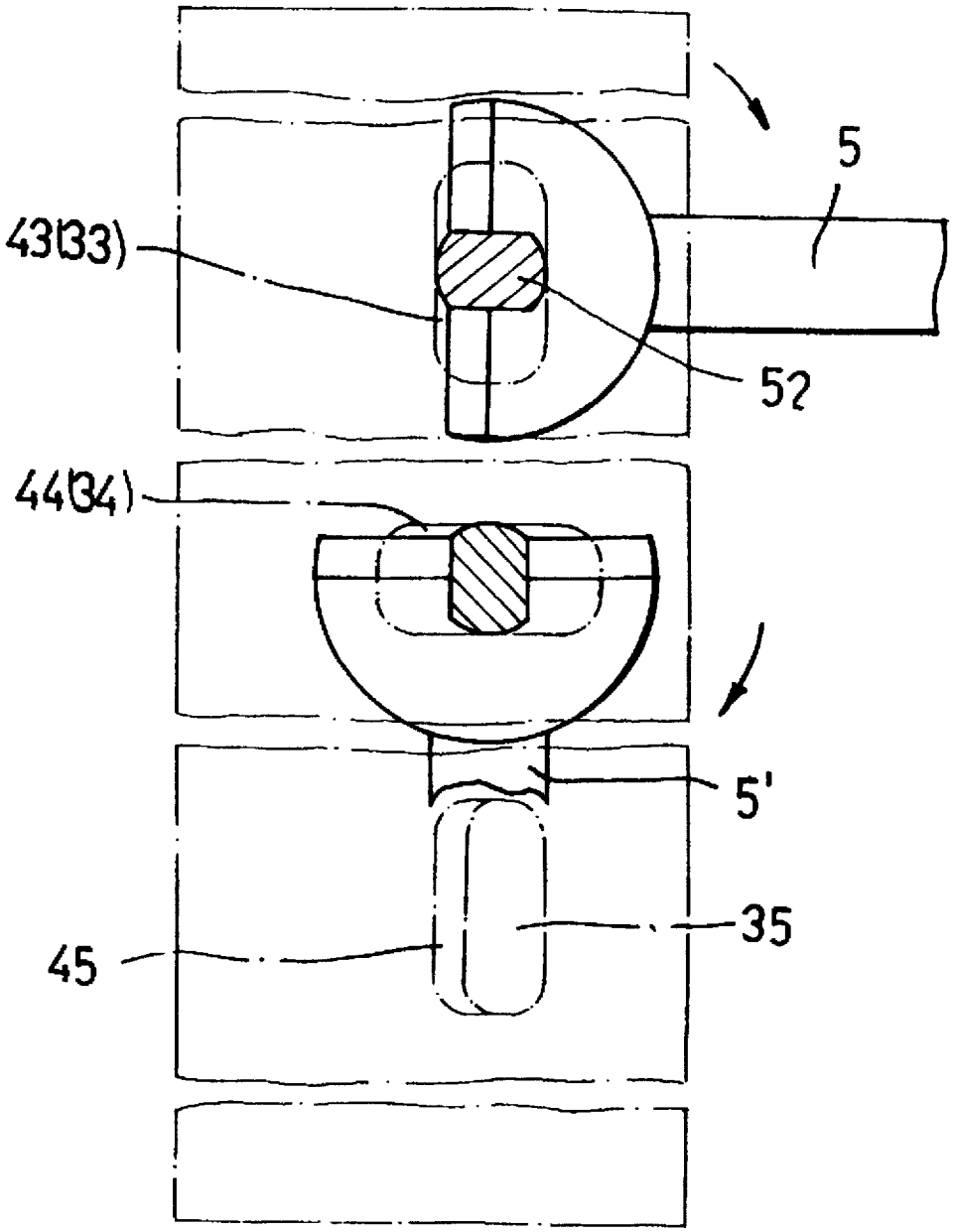
FIG. 11 is a schematic view illustrating how the fastening lever of FIG. 6 is operated.

With the aforementioned structures in mind, with reference to FIGS. 5 and 10, when the present invention is in use, the connecting plates 32, 42 are in contact with one another such that the upper positioning holes 33, 43 are generally aligned with one another. The head portion 53 of the fastening lever 5 then extends through the upper positioning holes 33, 43 with the neck portion 52 being received in the same. At this time, when the handle portion 50 is turned downwardly by a 90° angle, the head portion 53 and the base portion 51 clamp tightly the connecting plates 32, 43 therebetween in order to hold the connecting plates 32, 42 together and the shorter sides 521 of the neck portion 52 push the side walls 331, 431 to be flush with one another in order to fully align the positioning holes 33, 43. At this time, the mating edges 301, 401 and therefore the front faces of the flat panels 30, 40 are flush with one another. Similarly, the intermediate positioning holes 34, 44 can be fully aligned to allow the top and bottom edges 302, 304 of the flat panel 30 to be flush with the respective top and bottom edges 402, 404 of the flat panel 40 by means of another fastening lever 5', as best illustrated in FIG. 11.

Figure 12:
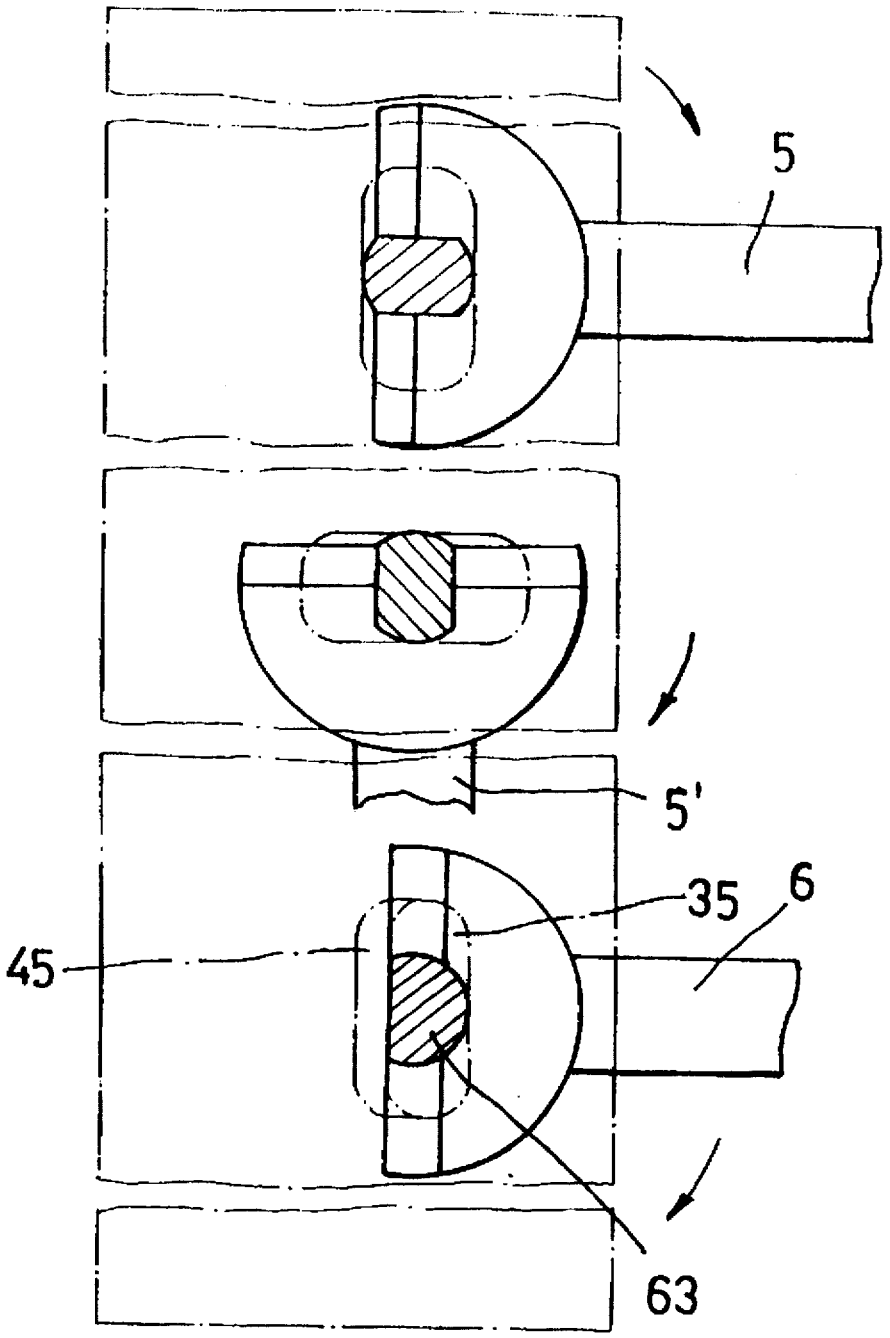
FIG. 12 is a schematic view illustrating how the fastening lever of FIG. 8 is operated.
Figure 13:
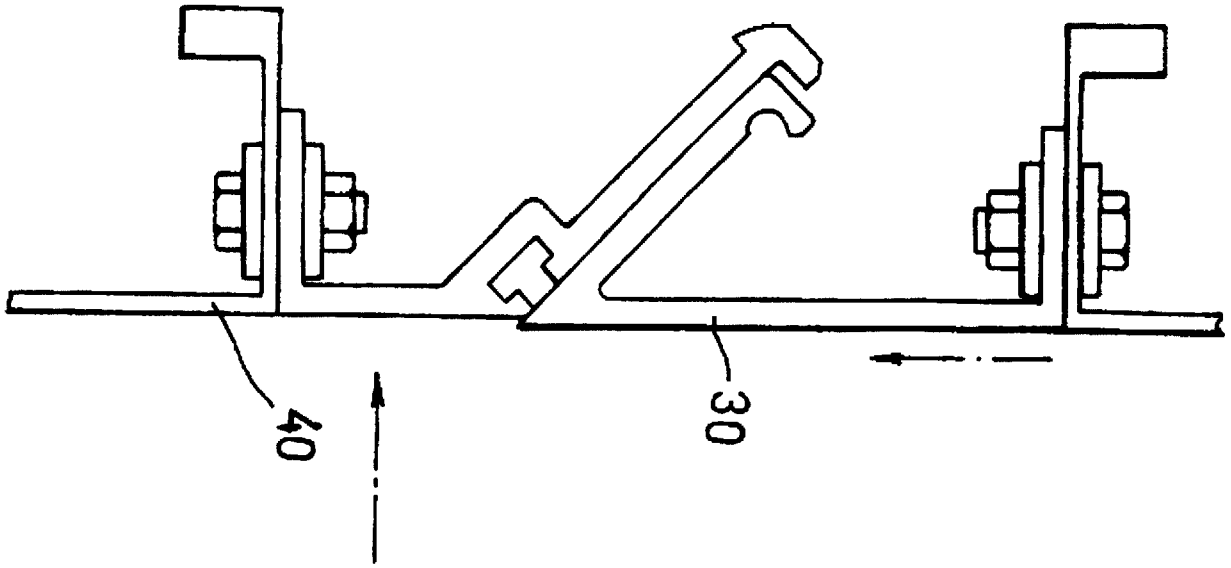
FIG. 13 is a schematic top view illustrating how the adjacent form units are moved relative to one another in order to form a clearance therebetween.

When the upper and intermediate positioning holes 33, 43, 34, 44 are fully aligned to permit the front faces and the top and bottom edges of the flat panels 30, 40 to be flush with another, the lower positioning holes 35, 45 are partially aligned with one another. In this state, the lower positioning holes 35, 45 can be used to perform a form-contracting operation. For example, the first and second form units 3, 4 are mounted at the middle portion of each side of the vertical wall form assembly 22, as shown in FIG. 2. Before the wall form assembly 22 is inserted into the top portions of the surround walls 20, the head portion 63 of the fastening lever 6 extends through the partially aligned positioning holes 35, 45 and the handle portion 60 is turned downwardly by a 90° angle to allow the neck potion 62 to push the side walls 351, 451 to be flush with one another on the ground, thereby resulting in relative movement of the first form unit 3 and the second wall form unit 4, as best illustrated in FIGS. 12 and 13. At this time, the front faces of the flat panels 30, 40 form a clearance therebetween. Because the mating edges 301, 401 are inclined, slight reward movement of the flat panel 30 will result in slight lateral movement of the flat panel 40. This illustrates how contraction of the entire bottom portion of the enclosing frame that is formed by the form units 220 can be achieved. Although the degree of contraction is small, the contraction of the bottom of the enclosing frame facilitates hoisting of the floor form assembly 2 into the room that is confined by the surround walls 20 via the open top of the room. After the floor form assembly 2 has been installed on the top portion of the surrounding walls 20, the fastening lever 6 are released and removed. The front faces of the flat panels 30, 40 are flush with each other at this time. After the concrete has been poured and hardened, the first fastening lever 5, 5' are released and removed. The second fastening lever 6 is then turned to result in the relative movement of the form units 3 and 4 one again in order to facilitate the disengagement of the flat panels 30, 40 from the concrete wall faces. This is a simple operation for dismantling of the form units 3, 4 from the concrete wall.

Further, the clamping lever 7 is used to enhance the engagement and the alignment effect of the form units 3, 4, as shown in FIG. 10. When in use, distal end portions of the overlapping first and second hook portions 36, 46 extend into the hook-shaped portion 71 of the clamping lever 7 via the clearance 75. The handle portion 70 is then rotated such that the curved face 761 of the distal end 76 engages the inner face 361 of the first hook portion 36 and the outer face 462 of the second hook portion 46 engages the inner face of the first curved section 73. Thus, the hook portions 36, 46 are clamped firmly between the distal end 76 of the second curved section 74 and the first curved section 73. Therefore, the form units 3, 4 can be held securely in position so that the flat panels 30, 40 are flush with one another. On the contrary, the hook-shaped portion 71 can be easily detached from the first and second hook portions 36, 46 by rotating reversely the handle portion 70 of the clamping lever 7. The clamping lever 7 may be used for clamping and aligning purposes when the second fastening lever 6 is released.

Figure 14:
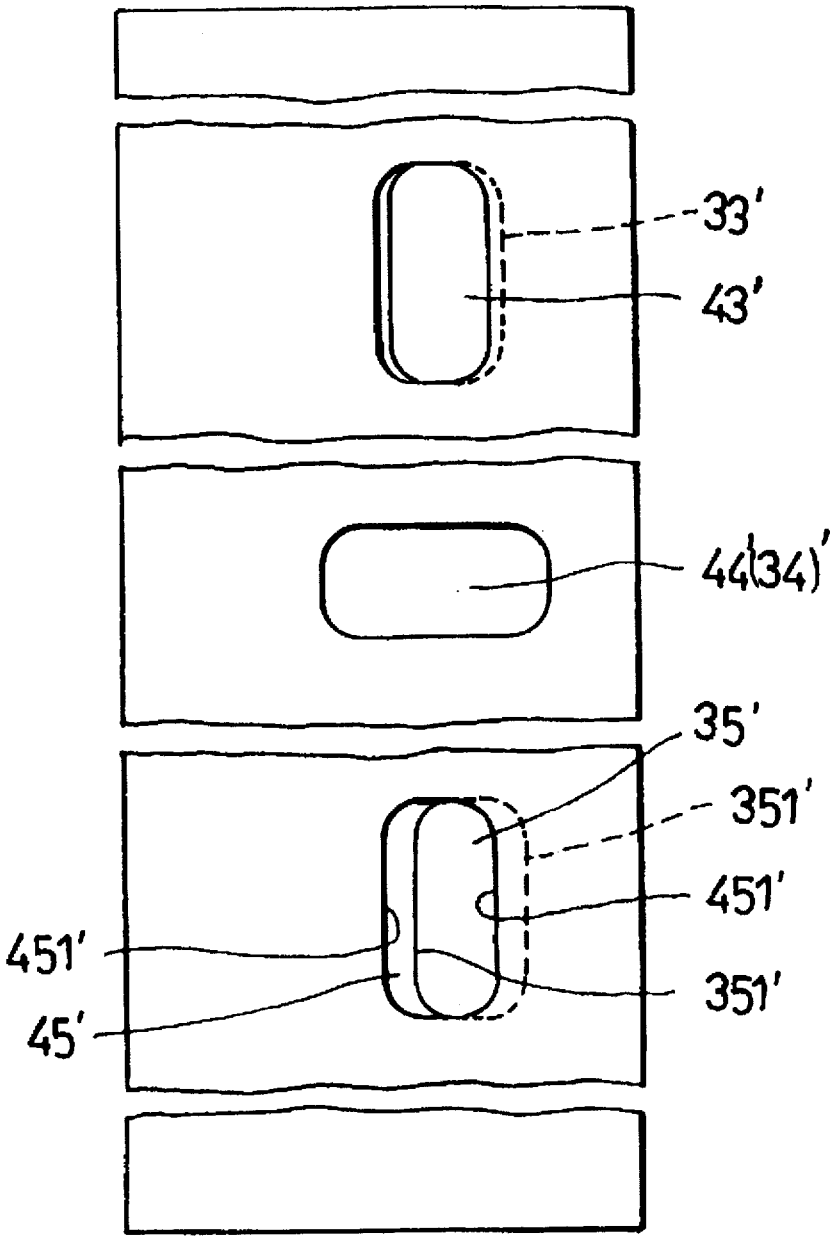
FIG. 14 is a fragmentary plan view of the connecting plates of two adjacent form units of another preferred embodiment of a modular wall form assembly according to the present invention.
Figure 15:
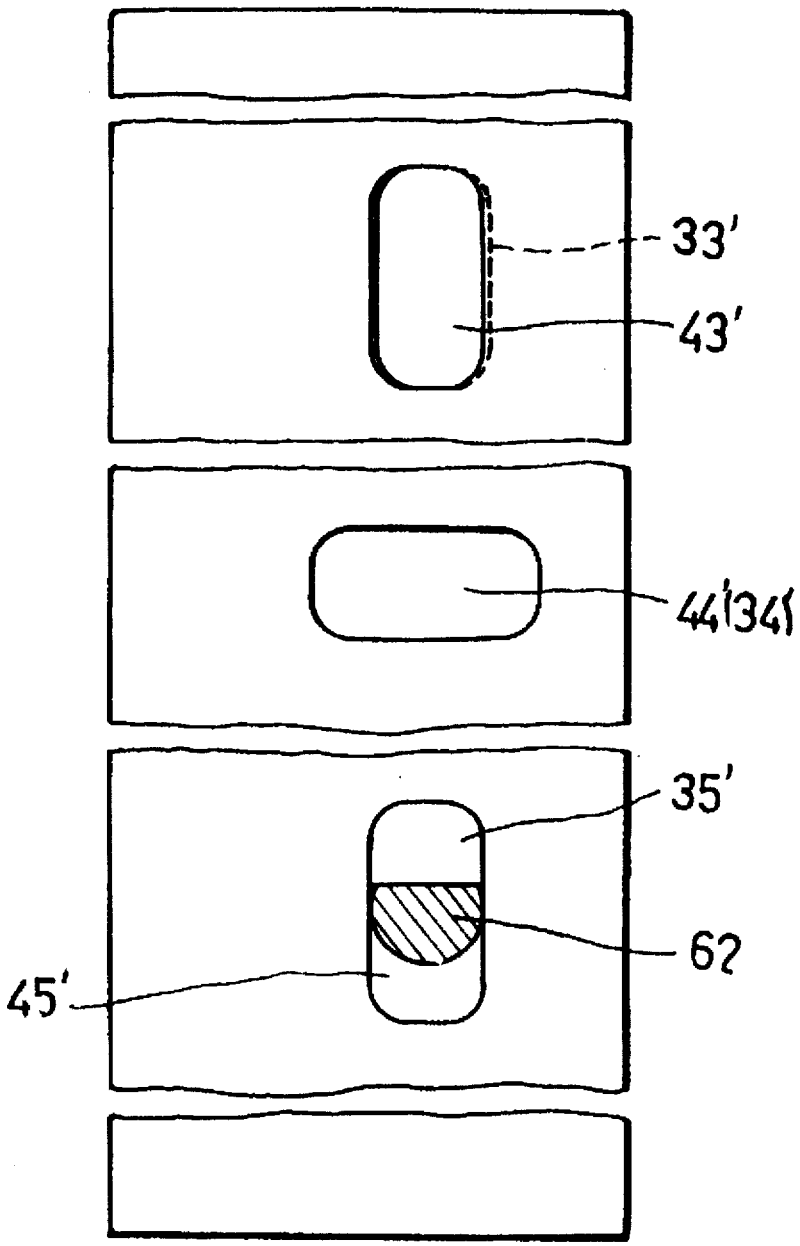
FIG. 15 is a schematic view illustrating how the fastening lever of FIG. 8 engages the positioning holes of the connecting plates of FIG. 14.

From above, it is understood that each pair of the positioning holes of the connecting plates can be inserted by a corresponding one of the levers, or the three pairs of positioning holes can be inserted by two of the levers. Of course, there are various combination ways to use the levers and positioning holes. Referring to FIG. 14, an alternative embodiment of the present invention is shown. In this embodiment, the upper positioning holes 33', 43' are staggered slightly with each other to an extent which is less than that of the staggered lower holes 35', 45'. Therefore, when the lower positioning holes 35', 45' is fully aligned by means of the second fastening lever 6, the bottom portions of the form units 3, 4 can be moved relative to one another while the form units 3, 4 are not deflected unduly. In this embodiment, the intermediate positioning holes 34', 44' are first aligned by means of the first fastening lever 5. The lower positioning holes 35', 45' are aligned by means of the second fastening lever 6. At this time, the form units 3, 4 moved relative to one another. Finally, another second fastening lever 6 is inserted into the nearly aligned upper fastening holes 33', 43' for clamping purposes, as shown in FIG. 15. At this time, the bottom portion of the enclosing frame of the wall form assembly 22 are contracted so that the bottom portion of the wall form assembly 22 can be easily inserted into the top portion of surrounding walls 20. After the floor form assembly 2 is properly mounted on the top portion of the surrounding walls 20, the levers 5, 6 are released and removed and the three clamping levers 7 are used to clamp tightly the form units 3, 4 to ensure the flat panels 30, 40 to be flush with one another.

The advantages of the present invention are as follows:

1. The form units 3, 4 can be retained together and aligned with one another simultaneously.

2. The form units 3, 4 can be retained and aligned simply by means of inserting the head portions of the levers into the at least partially aligned positioning holes and rotating the handle portions of the levers.

3. Two form units can be retained, aligned and contracted by means of various arrangements of the positioning holes.

4. The connecting plates 32, 42 are simple in structure and are easy to manufactured. In the preferred embodiment, the connecting plates 32, 42 are formed integrally with the flat panels 30, 40 and the joining plates 31, 41.

While the present invention has been described in connection with what is considered the most practical and preferred embodiment, it is understood that this invention is not limited to the disclosed embodiments but is intended to cover various arrangements included within the spirit and scope of the broadest interpretations and equivalent arrangement.

I claim:

1. A modular wall form assembly comprising:

a first form unit having an upright first flat panel with a mating edge, a first connecting plate extending rearwardly and inclinedly from said mating edge of said first flat panel, said first connecting plate having a first positioning hole, said first positioning hole having a generally oblong cross-section with a first width, a first length which is larger said first width, and a pair of opposed side walls defining said first width of said first positioning hole;

a second form unit having an upright second flat panel with a mating edge, a second connecting plate extending rearwardly and inclinedly from said mating edge of said second flat panel, said second connecting plate having a second positioning hole, said second positioning hole having a generally oblong cross-section with a second width, a second length which is larger said second width, and a pair of opposed side walls defining said second width of said second positioning hole, said second width of said second positioning hole equal to said first width of said first positioning hole, said first and second connecting plates being adapted to contact complementarily one another when said first and second flat panels are disposed side-by-side such that said first and second positioning holes are at least partially aligned with one another; and a fastening lever having a handle portion and a fastening portion formed on one end of said handle portion, said fastening portion having a base portion with a flat fastening face, and a neck portion which projects from said fastening face and which has a generally oblong cross-section with a length and a width that equals said width of said first and second positioning holes, said neck portion having two opposed shorter sides in a lengthwise direction, said fastening portion further having an enlarged head portion connected to a distal end of said neck portion, said head portion having a generally oblong cross-section and a longitudinal axis parallel to that of said neck portion in order to form a clamping space between said head portion and said fastening face of said base portion, said head portion has a width which is smaller than said width of said first and second positioning holes and a length which is smaller than said length of said first and second positioning holes so that said head portion of said fastening lever can extend through said first and second positioning holes with said neck portion being received in said first and second positioning holes when said first and second positioning holes are at least partially aligned with one another;

whereby, after said head portion has been extended through said first and second positioning holes and said neck portion has received in said first and second positioning holes while said first and second positioning holes are partially aligned, said fastening lever can be rotated such that said shorter sides of said neck portion abut tightly against said side walls of said first and second positioning holes and said side walls are received in said clamping space between said head portion and said base portion, thereby pushing each of said side walls of said first positioning hole to be flush with a corresponding one of said side walls of said second positioning hole and retaining said first and second connecting plates between said head portion and said base portion of said fastening lever.

2. A modular wall form assembly as claimed in claim 1, wherein each of said first and second positioning holes has a longitudinal axis parallel to said mating edges of said first and second flat panels so that front faces of said first and second flat panels can be flush with one another when said side walls of said first and second positioning holes are flush with one another.

3. A modular wall form assembly as claimed in claim 1, wherein each of said first and second positioning holes has a longitudinal axis parallel to said mating edges of said first and second flat panels, front faces of said first and second flat panels being flush with one another when said first and second positioning holes are partially aligned so that a clearance is formed between said front faces of said first and second flat panels when said side walls of said first and second positioning holes are flush with one another.

4. A modular wall form assembly as claimed in claim 1, wherein each of said first and second positioning holes has a longitudinal axis perpendicular to said mating edges of said first and second flat panels so that top and bottom edges of said first and second flat panels can be flush with one another when said side walls of said first and second positioning holes are flush with one another.

5. A wall form assembly as claimed in claim 1, wherein said head portion is displaced from said fastening face of said base portion of said fastening portion by a distance equal to combined thickness of said first and second connecting plates so that said first and second connecting plates can be firmly clamped between said head portion and said base portion of said fastening portion.

6. A modular wall form assembly comprising:

a first form unit having an upright first flat panel with a mating edge, a first connecting plate extending rearwardly and inclindedly from said mating edge of said first flat panel, said first connecting plate having a distal edge which is formed with a first hook portion, said first hook portion having an outer face;

a second form unit having an upright second flat panel with a mating edge, a second connecting plate extending rearwardly and inclindedly from said mating edge of said second flat panel, said second connecting plate having a distal edge which is formed with a second hook portion, said second hook portion having an inner face, said first and second connecting plates being adapted to complementarily contact one another, said second hook portion engaging fittingly and removably said first hook portion when said first and second connecting plates contact one another such that said inner face of said second hook portion abuts against said outer face of said first hook portion;

a clamping lever having a handle portion and a hook-shaped portion, said hook-shaped portion having a first curved section which extends from one end of said handle portion, and a second curved section which extends from a distal end of said first curved section, said second curved section having a distal end which forms a clearance with said first curved section, said clearance having a width equal to combined thickness of said first and second hook portions;

whereby, after said first hook portion of said first connecting plate engage said second hook portion of said second connecting plate, said first and second hook portions can be inserted into the hook-shaped portion of clamping lever via said clearance and clamped between said first curved section and said distal end of said second curved section of said clamping lever.

* * * * *